US006315171B1

(12) United States Patent
Piscopo et al.

(10) Patent No.: US 6,315,171 B1
(45) Date of Patent: Nov. 13, 2001

(54) TELESCOPING RAM DISPENSER

(75) Inventors: Peter Piscopo, Medford, NJ (US); Richard Seager, Mystic, CT (US)

(73) Assignee: The Plastek Group, Erie, PA (US)

( * ) Notice: Subject to any disclaimer, the term of this patent is extended or adjusted under 35 U.S.C. 154(b) by 0 days.

(21) Appl. No.: 09/676,353

(22) Filed: Sep. 29, 2000

(51) Int. Cl.[7] ..... B67D 5/42; F16B 21/00

(52) U.S. Cl. ..... 222/386; 222/405; 403/329; 403/12

(58) Field of Search ..... 222/386, 137, 222/320, 405; 403/326, 329, 315, 12

(56) References Cited

U.S. PATENT DOCUMENTS

| | | | | |
|---|---|---|---|---|
| 3,007,611 | | 11/1961 | Coolidge | 222/137 |
| 3,166,221 | | 1/1965 | Nielsen | 222/137 |
| 3,760,986 | | 9/1973 | Castner et al. | 222/137 |
| 3,827,602 | | 8/1974 | Nicholls | 222/94 |
| 4,121,739 | | 10/1978 | Devaney et al. | 222/137 |
| 4,437,584 | | 3/1984 | Connors et al. | 222/390 |
| 4,438,871 | | 3/1984 | Eckert | 222/137 |
| 4,687,663 | | 8/1987 | Schaeffer | 424/52 |
| 4,836,423 | | 6/1989 | Hayes et al. | 222/257 |
| 4,899,910 | * | 2/1990 | Tabei et al. | 222/54 |
| 4,907,726 | | 3/1990 | Harris | 222/145 |
| 4,961,520 | | 10/1990 | White | 222/135 |
| 4,964,539 | | 10/1990 | Mueller | 222/94 |
| 4,989,758 | | 2/1991 | Keller | 222/137 |
| 5,033,650 | | 7/1991 | Colin et al. | 222/137 |
| 5,092,496 | | 3/1992 | Gayle et al. | 222/386 |
| 5,104,009 | | 4/1992 | Battegazzore | 222/209 |
| 5,316,186 | | 5/1994 | Prestele | 222/327 |
| 5,348,392 | | 9/1994 | Bouquet et al. | 366/162 |
| 5,351,862 | | 10/1994 | Weag | 222/145 |
| 5,547,107 | | 8/1996 | Boiardi | 222/1 |
| 5,611,463 | | 3/1997 | Favre | 222/137 |
| 5,673,821 | | 10/1997 | Davis et al. | 222/137 |
| 5,687,885 | | 11/1997 | Turk et al. | 222/512 |
| 5,699,935 | | 12/1997 | Stahley | 222/94 |
| 5,740,947 | | 4/1998 | Flaig et al. | 222/135 |
| 6,056,164 | * | 5/2000 | Wakayama | 222/327 |

* cited by examiner

*Primary Examiner*—Kevin Shaver
*Assistant Examiner*—Patrick Buechner
(74) *Attorney, Agent, or Firm*—Bachman & LaPointe, P.C.

(57) ABSTRACT

A product dispenser including a body housing defining a product cavity for holding a product, a piston movably disposed within the product cavity and a ram assembly aligned with the piston, the ram assembly being adjustable between a storage position for engaging the piston at a storage height and a dispensing position for engaging the piston at a dispensing height, the dispensing height being larger than the storage height.

20 Claims, 3 Drawing Sheets

TELESCOPING RAM DISPENSER

BACKGROUND OF THE INVENTION

The present invention relates to a product dispenser, for dispensing extrudable single or multiple component substances, that can be configured into either a storage configuration, for storage/shipping, or into a dispensing configuration, for product extrusion. Some examples of extrudable products would be dentifrice materials (toothpaste, whitening gels), cosmetic materials (creams, lotions, deodorants) and the like.

Most conventional dispensers require a ram having an equal or larger length as the dispenser cavity so that all of the product contained within the dispenser cavity can be dispensed. Subsequently, while the dispenser is full, the ram extends out of the dispenser causing these dispensers to be roughly twice the size of the dispenser cavity which is undesirable for storage and shipping purposes.

The need remains for a product dispenser that has a product carrying capacity comparable to conventional product dispensers, but that occupies less space during shipping and storage than is currently required for conventional dispensers.

It is an objective of the present invention to provide a dispenser wherein the dispenser can be adjusted into a storage/shipping configuration such that the actual space required to store/ship this dispenser is the same or only slightly larger than the space occupied by the product cavity housing. This configuration will advantageously allow for a substantial reduction in the space required for dispenser shipping/storage.

Other objects and advantages will appear hereinbelow.

SUMMARY OF THE INVENTION

In accordance with the present invention, the foregoing objects and advantages are readily attained.

According to the invention, a product dispenser is provided which includes a body housing defining a cavity for holding a product, a piston movably disposed within the product cavity, and a ram assembly aligned with the piston, the ram assembly being adjustable between a storage position for engaging the piston at a storage height and a dispensing position for engaging the piston at a dispensing height, wherein the dispensing height is larger than the storage height.

BRIEF DESCRIPTION OF THE DRAWINGS

A detailed description of preferred embodiments of the present invention follows, with reference to the attached drawings, wherein.

DETAILED DESCRIPTION

Figure 1:
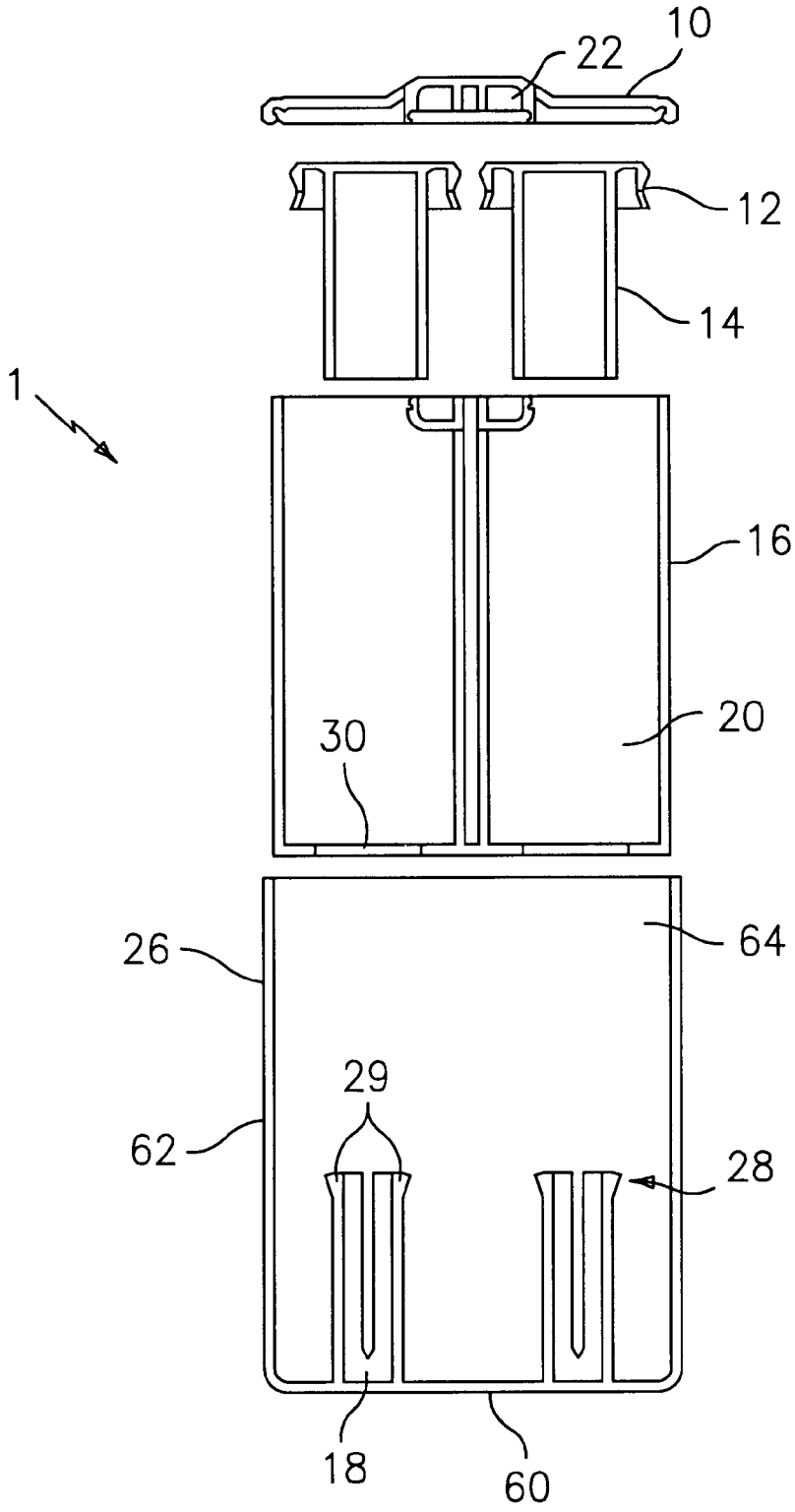
FIG. 1 is an exploded front view of a product dispenser in accordance with the present invention.

In accordance with the present invention, a product dispenser is provided which has a body housing defining a product cavity for holding a product. The body housing includes a housing bottom having a bottom opening to facilitate engagement of the ram assembly with the piston, a housing front and a cap used to enclose the product within the product cavity. The cap is removably disposed on top of the body housing and defines in combination with the body housing, a channel communicated with the product cavity for extruding a product.

In accordance with the present invention, the product dispenser includes a piston which is movably disposed within the product cavity and which is preferably sized and shaped similar to the product cavity so as to sealingly interact with the body housing to prevent the product from leaking out of the product cavity. The piston is preferably able to traverse the entire length of the product cavity and is sufficiently large or larger than the bottom opening so as to be prevented from being removed from the product cavity through the bottom opening.

In accordance with the present invention, the product dispenser includes a body support having a support bottom and a support wall that defines a housing cavity for holding and guiding the body housing relative to the body support during product extrusion. The support bottom and support wall is sized and shaped so as to supportably contain and guide the body housing during storage and usage.

The product dispenser includes a ram assembly having a telescoping ram that includes an upper ram having an outer ram diameter that is preferably smaller than the bottom opening and a lower ram wherein the lower ram is disposed within the housing cavity and attached to the support bottom. The ram assembly is capable of being adjusted between a dispensing position having a dispensing height and a storage position having a storage height, wherein the dispensing height is larger than the storage height. In addition, the product cavity has a product cavity height which is equal to or smaller than the storage height. The upper ram is movably attached to the lower ram and is connected to the piston through the bottom opening. Either the upper ram or the lower ram defines a ram cavity and the other of the upper ram or the lower ram is movably disposed within the ram cavity. In addition, the ram assembly includes a locking structure wherein when the ram assembly is in the dispensing position, the locking structure engages either the upper ram or the lower ram with the other of the upper ram or the lower ram so as to prevent the ram assembly from retracting into the storage position. The locking structure has a flanged, compressible side wall on either the upper ram or the lower ram, where the side wall has an adjustable diameter. The adjustable diameter, and hence the locking structure, is preferably positionable between a decompressed diameter and a compressed diameter, wherein the decompressed diameter is larger than the compressed diameter. When the ram assembly is in the storage position, the adjustable diameter is positioned to the compressed diameter and when the ram assembly is in the adjustable diameter is positioned to the decompressed diameter. When the ram assembly is in the dispensing position, the locking structure engages either the compressed diameter or the decompressed diameter with the other of the upper ram or the lower ram preventing movement of the ram assembly from the dispensing position toward the storage position. This prevention of retraction allows the ram to exert an upward force on the piston and hence any product contained within the product cavity, thereby dispensing product.

In accordance with the present invention, it is considered within the scope of the present invention that other locking mechanisms may be used to prevent the product dispenser from retracting into its storage position.

Referring to the drawings, a preferred embodiment of the invention will be discussed.

Figure 2:
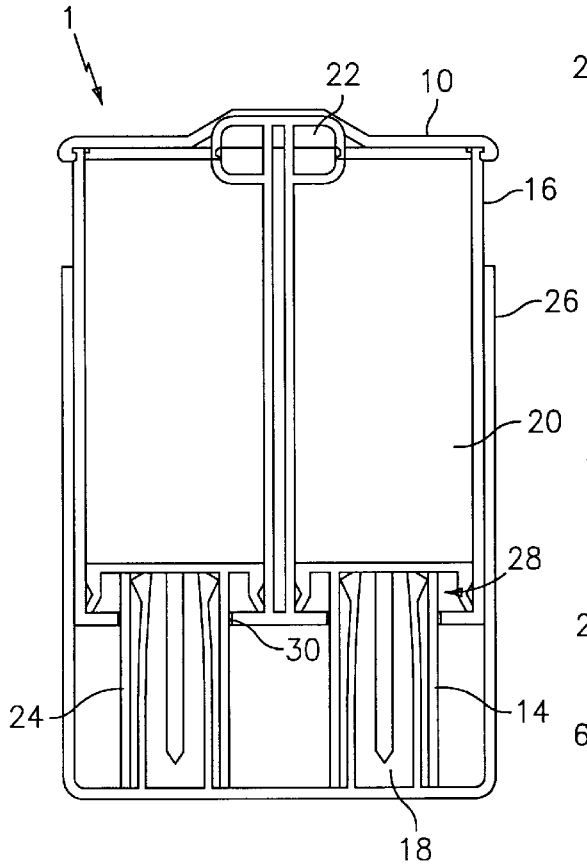
FIG. 2 is a front sectional view of a product dispenser in accordance with the present invention in its storage position
Figure 3:
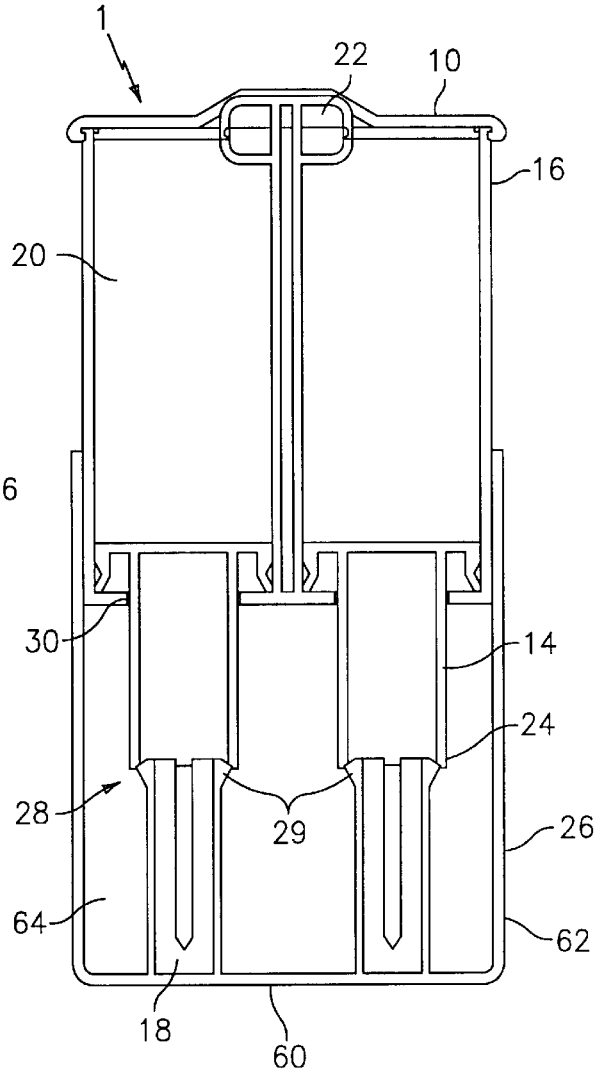
FIG. 3 is a front sectional view of a product dispenser in accordance with the present invention in its dispensing position.

In accordance with the present invention, FIG. 2 illustrates a dispenser 1 with the ram assembly in the storage position and FIG. 3 illustrates a dispenser 1 with the ram assembly in the dispensing position. FIG. 2 and FIG. 3 show a dispenser 1 in accordance with the present invention including a cap 10, a body housing 16, a body support 26 and a ram assembly 24 having a piston 12, an upper ram 14 and a lower ram 18, wherein the ram assembly 24 also includes a locking structure 28. In addition, body housing 16 has a bottom opening 30, a channel 22 and a product cavity 20, wherein the channel 22 is formed by the combination of the cap 10 and the body housing 16 and is communicated with the product cavity 20. The body support 26 has a support bottom 60, a support wall 62 and a housing cavity 64. In this embodiment, referring to FIG. 3, locking structure 28 has two flanged, compressible sides 29 located on lower ram 18, wherein said flanged, compressible side 29 is engaged with upper ram 14 so as to prevent ram assembly 24 from retracting into the storage position as shown in FIG. 2.

In this embodiment, the body housing 16 preferably includes multiple wall structures defining two product cavities 20 for containing a product therein. The body housing 16 also preferably contains two dispensing channels 22, each communicated with each product cavity 20 such that the product located within each product cavity 20 can be extruded through the respective dispensing channel 22. The body housing 16 preferably contains one piston 12 located within each product cavity 20 and aligned with each bottom opening 30 so as to accommodate the connection between the piston 12 and the upper ram 14. The piston 12 is preferably sized and shaped so as to sealingly engage and interact with the body housing 16 preventing the product from leaking out of the product cavity 20.

As illustrated in FIG. 2, when the ram assembly 24 is in the storage position, the ram assembly 24 is fully retracted. This advantageously allows the product dispenser 1 to achieve a storage height substantially equal to the product cavity height.

As illustrated in FIG. 3, when the ram assembly 24 is in the dispensing configuration, the ram assembly 24 is fully extended and locked into its extended position. This is accomplished by pulling the body housing 16 away from the support bottom 60 until the ram assembly 24 is fully extended and the locking structure 28 is engaged. As the body housing 16 is pulled away from the support bottom 60, the bottom portion of the body housing 16 pushes against the piston 12 thereby forcing the piston 12 away from the body support 26 and extending the ram assembly 24. Once the lower ram 18 is sufficiently extended, the flanged, compressible sides 29 are allowed to decompress thereby engaging the locking structure 28. The locking structure 28 functions by increasing the diameter of the flanged, compressible sides 29 such that they exceed the diameter of either the upper ram 14 or the lower ram 18 allowing the other of the upper ram 14 or the lower ram 18 to rest on the flanged lip of the flanged compressible sides 29 thereby preventing the ram assembly 24 from retracting into the storage position.

Figure 4:
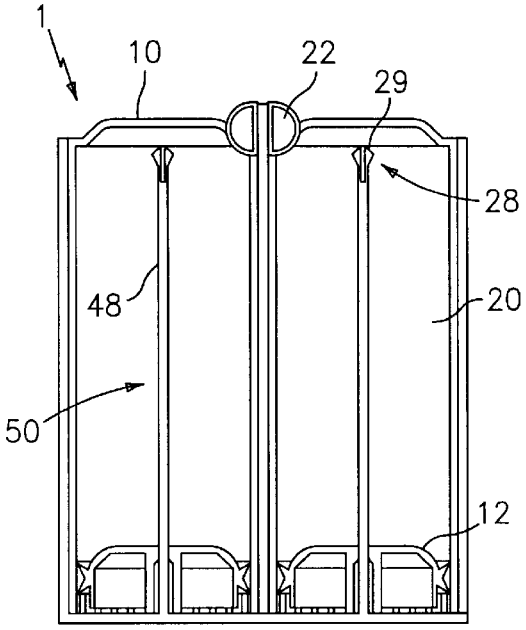
FIG. 4 is a front sectional view of an alternate product dispenser in accordance with the present invention in its storage position.
Figure 5:
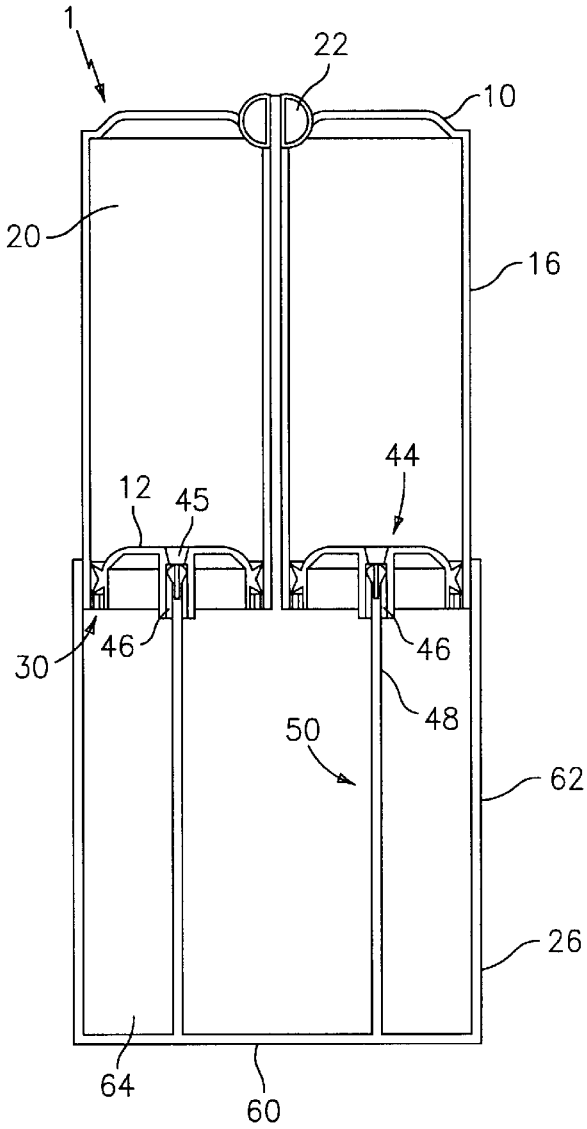
FIG. 5 is a front sectional view of an alternate product dispenser in accordance with the present invention in its dispensing position.

In accordance with the present invention, FIG. 4 and FIG. 5 illustrate a further embodiment of the product dispenser implementation as shown and described below.

Referring to FIG. 4 and FIG. 5, in accordance with the present invention, this embodiment allows the dispenser 1 to adjust between a storage position, as shown in FIG. 4 and a dispensing position, as shown in FIG. 5. The ram assembly 50 includes a ram slidably associated with the piston 12 between a storage height and a dispensing height. When the dispenser 1 is in the storage position, piston 12 is disposed so as to be separated from the support bottom 60 by a storage height and when the dispenser 1 is in the dispensing position, piston 12 is disposed so as to be separated from the support bottom 60 by a dispensing height, wherein said dispensing height is larger than the storage height.

The piston 12 of this embodiment is preferably located inside each cavity 20 and has a channel 44 having an upper channel portion 45 with an upper channel diameter and a lower channel portion 46 with a lower channel diameter, wherein the upper channel diameter is smaller than the lower channel diameter.

The ram assembly 50 preferably comprises a ram 48 with an upper ram portion having an upper ram diameter that is equal to or smaller than the upper channel diameter. This upper ram portion is relatively thin as compared to the product cavity 20 and has a flanged, compressible side 29 located at the top of the ram 48.

In the storage position, the body housing 16 is retracted into the body support 26 such that the body housing 16 is disposed within the body support 26. The piston 12 is at the storage height and is disposed at the bottom of each product cavity 20. The upper ram portion of ram 48 extends through the channel 44 into the product cavity 20. Because ram 48 is relatively thin as compared to product cavity 20, the ram 48 can be stored within product cavity 20 without substantially effecting product carrying capacity.

In the dispensing position, the body housing 16 is extended away from the body support 26 such that the upper ram portion of ram 48 no longer extends through the channel 44 into the product cavity 20, but is disposed within the lower channel portion 46 of the piston 12. When the top of the ram 48 enters the lower channel portion, the locking structure engages the upper channel portion preventing the piston from retracting back toward the storage position. This locking structure locks the ram relative to the piston into the dispensing height. As in the previous embodiment, the locking structure 28 includes a flanged, compressible side 29 which has a compressed diameter and a decompressed diameter, wherein the decompressed diameter is larger than the compressed diameter and the upper channel diameter and smaller than the lower channel diameter. In addition, the piston 12 is larger in size than the bottom opening 30 such that piston 12 is engaged by the body housing 16 when the dispenser is extended into its dispensing position. The piston 12 is larger than the bottom opening 30, so as to be contained within the product cavity 20. The piston 12 is movably disposed within product cavity 20 and is capable of traversing the entire length of the product cavity 20 such that the product is forced out of the its dispensing channel 22.

As illustrated in FIG. 4, when the piston 12 is in the storage position, a substantial portion of the ram 48 is located within the product cavity 20 thereby reducing the storage height of the product dispenser to the approximate height of the product cavity 20.

As illustrated in FIG. 5, when the dispenser is extended into the dispensing position, the body housing 16 is extended away from the body support 26. As the body housing 16 is extended away from the body support 26, the piston 12 is forced upward traversing the ram 48. As the piston 12 approaches the top of the ram 48, the flanged, compressible side 29 of the ram 48 is compressed by the upper channel portion 45 until it is small enough to traverse the upper channel portion 45. As the flanged, compressible side 29 of the ram 48 leaves the upper channel portion 45 and enters the lower channel portion 46 the flanged, compressible side 29 decompresses and engages the locking structure preventing the piston 12 from traversing back down the ram 48. This decompression of the flanged, compressible side 29 allows the piston 12 to rest on the flanged, compressible side 29 preventing the dispenser from retracting into the storage position. In addition, this provides support to the piston 12 to force the product out of the product cavity 20.

Referring back to FIG. 1, FIG. 2, FIG. 3, FIG. 4 and FIG. 5, the body housing 16, as shown, preferably includes a plurality of pistons 12, product cavities 20 and channels 22, wherein each channel 22 is communicated with at least one product cavity 20.

In accordance with the present invention the cap 10, piston 12, body support 26, ram assembly 48 and body housing 16 may advantageously be constructed of any material suitable to the desired end product. An example of a suitable material is polypropylene and the like.

In addition, this product dispenser in accordance with the present invention advantageously provides for a reduced storage/shipping space requirement while maintaining a conventional product dispenser holding capacity.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. A product dispenser, comprising:

a body housing defining a product cavity for holding a product;

a piston movably disposed within said product cavity; and a ram assembly aligned with said piston, said ram assembly being adjustable between a storage position for engaging said piston at a storage height and a dispensing position for engaging said piston at a dispensing height said dispensing height being larger than said storage height, said ram assembly further comprising a locking structure, and wherein when said ram assembly is in said dispensing position, said locking structure prevents said ram assembly from retracting into said storage position.

2. A dispenser according to claim 1, wherein said product cavity comprises a product cavity height, said product cavity height being equal to or smaller than said storage height.

3. A dispenser according to claim 1, further comprising a body support defining a housing cavity for holding said body housing, said body support having a support bottom and a support wall, said support wall being sized and shaped so as to guide and support said body housing relative to said body support.

4. A dispenser according to claim 3, wherein said ram assembly comprises an upper ram and a lower ram, said lower ram being disposed within said housing cavity and connected to said support bottom and said upper ram being connected to said piston.

5. A dispenser according to claim 1, wherein said body housing comprises a housing bottom having a bottom opening to facilitate engagement of said ram assembly with said piston, a housing front and a cap removably disposed on said body housing, wherein said housing front and said cap define in combination a channel communicated with said product cavity.

6. A dispenser according to claim 5, wherein said piston is sized so as to sealingly interact with said body housing, said piston being larger than said bottom opening such that said piston is held within said product cavity.

7. A dispenser according to claim 5 wherein said ram assembly comprises an upper ram having an outer ram diameter, said outer ram diameter being smaller than said bottom opening and said upper ram being joined to said piston through said bottom opening.

8. A dispenser according to claim 1, wherein said ram assembly comprises a telescoping ram having a lower ram and an upper ram.

9. A dispenser according to claim 8, wherein one of said upper ram and said lower ram defines a ram cavity and the other of said upper ran and lower ram is movably disposed within said ram cavity.

10. A dispenser according to claim 8, wherein said locking structure engages said upper ram with said lower ram so as to prevent said ram assembly from retracting into said storage position.

11. A dispenser according to claim 10 wherein said locking structure comprises a flanged, compressible side wall on one of said upper ram and said lower ram, said side wall having an adjustable diameter, said adjustable diameter being positionable between a decompressed diameter and a compressed diameter such that said decompressed diameter is larger than said compressed diameter.

12. A dispenser according to claim 11, wherein one of said compressed diameter and said decompressed diameter engages said other of said upper ram and said lower ram in said dispensing position so as to prevent movement of said ram assembly from said dispensing position toward said storage position.

13. A dispenser according to claim 11, wherein when said telescoping ram is in said storage position, said adjustable diameter is positioned to said compressed diameter and when said telescoping ram is in said dispensing position said adjustable diameter is positioned to said decompressed diameter.

14. A dispenser according to claim 1, wherein said ram assembly comprises a ram slidably associated with said piston between said storage height and said dispensing height.

15. A dispenser according to claim 14, wherein said locking structure comprises a flanged, compressible side wall positionable between a decompressed position and a compressed position.

16. A dispenser according to claim 15, wherein said piston comprises an inner wall defining a channel for receiving said ram, said channel having an upper channel portion with an upper channel diameter and a lower channel portion with a lower channel diameter, wherein said upper channel diameter is smaller than said lower channel diameter.

17. A dispenser according to claim 16, wherein when said flanged, compressible side wall is in said decompressed position, said flanged, compressible side wall has a decompressed diameter, said decompressed diameter being smaller than said lower channel diameter and larger than said upper channel diameter.

18. A dispenser according to claim 17, wherein when said ram assembly is in said dispensing position, said locking structure engages said upper channel portion so as to prevent said ram assembly from retracting toward said storage position.

19. A dispenser according to claim 18, wherein said ram has an upper ram portion having an upper ram diameter, said upper ram diameter being equal to or smaller in size then said upper channel diameter, such that when said ram assembly is in said storage position, said upper ram portion extends through said channel into said product cavity.

20. A dispenser according to claim 19, wherein when said ram assembly is in said dispensing position, said upper ram portion is disposed within said lower channel portion, thereby engaging said locking structure and preventing said body housing from retracting into said storage position.

* * * * *